United States Patent [19]

Kuraoka

[11] Patent Number: 4,531,958

[45] Date of Patent: Jul. 30, 1985

[54] HELIUM GAS LIQUEFYING APPARATUS

[75] Inventor: Yasuo Kuraoka, Sapporo, Japan

[73] Assignee: Hoxan Corporation, Sapporo, Japan

[21] Appl. No.: 579,671

[22] Filed: Feb. 13, 1984

[30] Foreign Application Priority Data

Feb. 14, 1983 [JP] Japan ..... 58-22576

[51] Int. Cl.[3] ..... F25J 3/00

[52] U.S. Cl. ..... 62/22; 62/38; 62/40

[58] Field of Search ..... 62/9, 11, 21, 22, 36, 62/37, 38, 39, 40

[56] References Cited

U.S. PATENT DOCUMENTS 3,792,591 2/1974 Collins ..... 62/22

*Primary Examiner*—Frank Sever

*Attorney, Agent, or Firm*—George B. Oujevolk

[57] ABSTRACT

A helium gas liquefying apparatus which has a compressor receiving helium gas stock, plural heat exchangers connected in series with each other via a series liquefying line, plural expansion engines connected in parallel with the corresponding heat exchangers, a Joule-Thompson's valve connected via the liquefying line, a series return line disposed in the reverse flow of the heat exchangers to the liquefying line, a recovery line connected from the reservoir through a recovery valve to the inlet of the compressor, first to third thermometers and a pressure gage. Thus, the apparatus can be fully automatized in various preliminary operations without complicated operations of the conventional apparatus by providing not only the thermometers and the pressure gage but a recovery valve interposed between a liquefied He reservoir and a recovery line.

1 Claim, 2 Drawing Figures

HELIUM GAS LIQUEFYING APPARATUS

This invention relates to a helium gas liquefying apparatus which produces liquefied helium gas by introducing helium gas stock and suitably cooling the gas.

Figure 1:
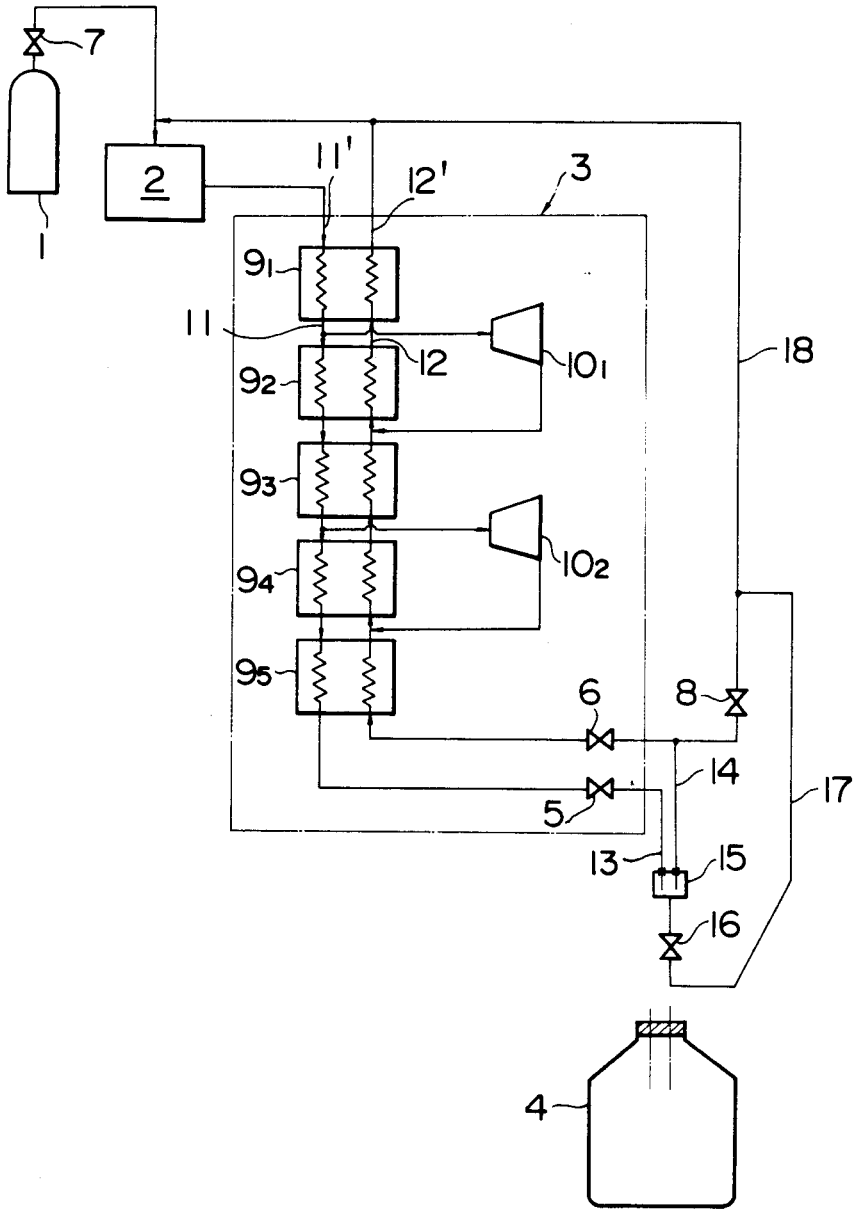
FIG. 1 PRIOR ART

A conventional helium gas liquefying apparatus of this type had a structure as shown in FIG. 1. In the structure, a helium gas bomb 1, a compressor 2, a cooler 3 and a liquefied helium reservoir 4 have been connected by piping with a J-T valve 5 (which performed Joule-Thompson's effect), a return valve 6 and control valves 7 and 8. The following preliminary various operations have been carried out before liquefied helium gas (LHe) was produced in the reservoir 4:

The valves 5 and 5 are closed, the compressor 2 is then operated, helium gas (GHe) is introduced from the bomb 1 into the compressor 2, and the GHe compressed by the compressor 2 is the fed to the cooler 3. The cooler 3 includes a plurality of heat exchangers $9_1$, $9_2$, $9_3$, $9_4$, $9_5$ and expansion engines $10_1$, $10_2$ known per se. A series liquefying line 11 and a series return line 12 with the respective heat exchangers are provided in parallel with one another via a reverse flow heat exchanging arrangement. When the compressed GHe is introduced from the inlet 11' of the line 11 to the cooler 3, the expansion engines $10_1$, $10_2$ are respectively connected in parallel with the second and fourth heat exchangers $9_2$ and $9_4$ between the lines 11 and 12, and the GHe exhausted from the line 11 of the first heat exchanger $9_1$ is branched to the first expansion engine $9_1$ is branched to the first expansion engine $10_1$, is expanded in the engine $10_1$, and the GHe which is thus lowered at its temperature via the expansion engine $10_1$ is sequentially passed through the line 12 of the second and first heat exchangers $9_2$ and $9_1$ and is returned to the inlet of the compressor 2 circularly. Thus, the GHe is gradually cooled via the first and second heat exchangers $9_1$. $9_2$.

Similarly, the second expansion engine $10_2$ cools the GHe branched from the third heat exchanger $9_3$, and the GHe is returned sequentially through the fourth, third, second and first heat exchangers $9_4$, $9_3$, $9_2$, $9_1$ to the compressor 2. In this manner, the GHe progressively cooled even via the circulating line and the first preliminary operation for cooling the GHe is carried out by circulating the GHe to the fourth heat exchanger $9_4$.

When the temperature of the inlet of the second expansion engine $10_2$ is thus decreased to a temperature lower than 20° K., delivery tubes 13 and 14 which have been connected, as designated by solid lines in FIG. 1, to the liquefied helium reservoir 4 so far, are removed, and connected to an adapter 15, as shown in FIG. 1. In this case, the adapter 15 is connected through a tube 17 which has a valve 16 disposed at the intermediary of the tube 17 to a recovery line 18, which is connected, as shown in FIG. 1, to the outlet 12' of a serial return line 12 and to the inlet side of the compressor 2.

When the adapter 15 is thus connected as described above, the J-T valve 5, return valve 6 and valve 16 are then opened to return the helium gas GHe from the adapter 15 through the valve 16 and the tube 17 to the recovery line 18, thereby cooling the delivery tubes 13 and 14 with the helium GHe. When liquid droplets of condensed dew from the atmospheric air start producing on the adapter 15, the J-T valve 5 and return valve 6 are closed, the adapter 15 is removed, and the delivery tubes 13 and 14 are connected back to the reservoir 4 to thus complete the various preliminary operations. Then, the J-T valve 5 and return valve 6 are then slightly opened to enter a liquefaction starting operation.

Since in the conventional helium gas liquefying apparatus thus constructed the adapter 15 should be mounted and dismounted, and the valve should be manually operated due to the cooling with the preliminary operation, its workability is undesirably deteriorated. Inasmuch as the outer wall of the adapter 15 must be additionally observed to know the cooling degree of the delivery tubes 13 and 14 as described above, accurately cooling state cannot be observed, the liquefaction is started before sufficient cooling has been completed, and the cooling efficiently is thus decreased as its drawback.

Accordingly, a primary object of this invention is to provide a helium gas liquefying apparatus in which all the aforementioned drawbacks and disadvantages of the conventional helium gas liquefying apparatus and which can be fully automatized in various preliminary operations without complicated operations of the conventional apparatus by providing not only thermometers and a pressure gage but a recovery valve interposed between a liquefied He reservoir and a recovery line.

The above and other related objects and features of the invention will be apparent from a reading of the following description of the disclosure found in the accompanying drawings and the novelty thereof pointed out in the appended claims.

Figure 2:
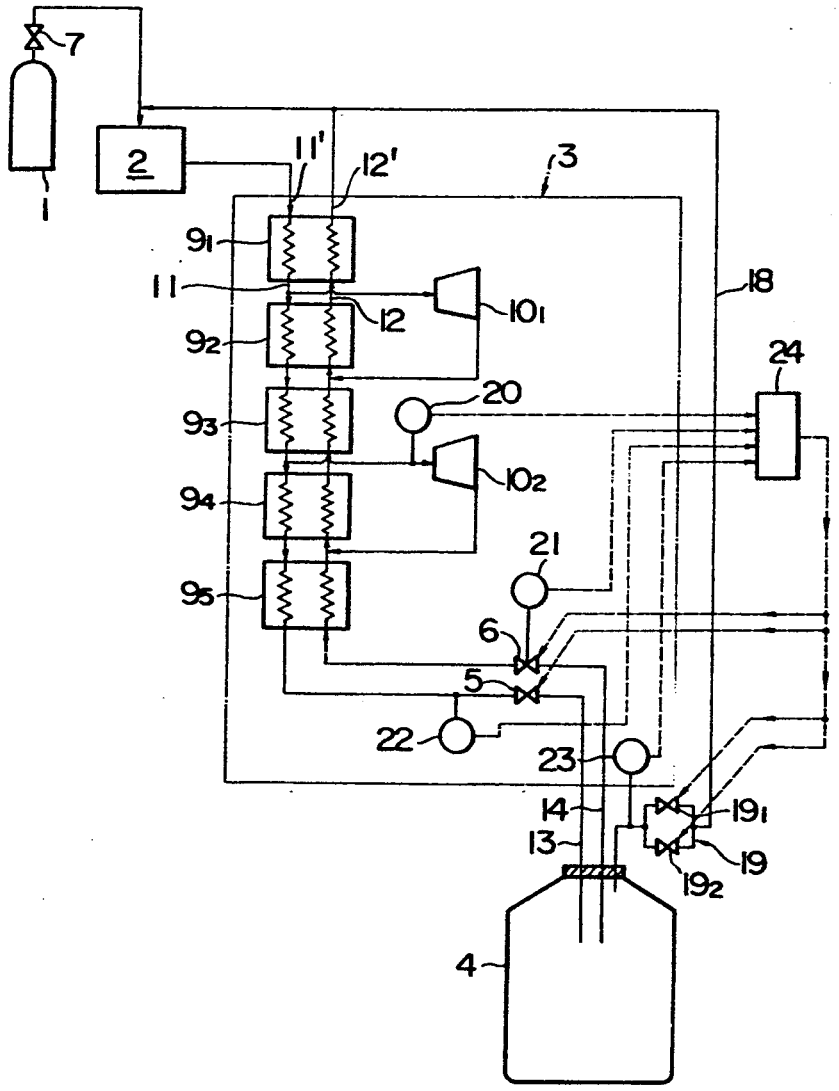

FIG. 1 is a schematic piping arrangement view showing a conventional helium gas liquefying apparatus; and FIG. 2 is a schematic piping arrangement view showing a preferred embodiment of a helium gas liquefying apparatus according to the present invention.

The present invention will now be described in more detail with reference to the accompanying drawings, which show a preferred embodiment of the present invention. In FIG. 2, the helium gas liquefying apparatus of the present invention comprises, as similarly to those of the conventional helium gas liquefying apparatus in FIG. 1, a helium gas bomb 1, a compressor 2, a cooler 3 which has first to fifth heat exchangers $9_1$ to $9_5$, first and second expansion engines $10_1$, $10_2$, a series liquefying line 11 and a series return line 12, a liquefied helium reservoir 4, delivery tubes 13 and 14 respectively having a J-T valve 5 and a return valve 6, and further a recovery line 18 in such a manner that the tubes 13 and 14 are inserted into the reservoir 4. Further, the apparatus of the invention is advantageously constructed such that a recovery valve 19 is interposed at the recovery line 18 between the compressor 2 and the reservoir 4. The valve 19 may be composed of branch valves $19_1$ and $19_2$ disposed in parallel with one another, or of a valve which is controlled in flow rate according to the degree of opening.

In the embodiment of the present invention, as shown in FIG. 2, the apparatus further advantageously comprises a first thermometer 20 which is provided at the inlet side of the expansion engine $10_2$ of the final stage, a second thermometer 21 for detecting the body temperature of the return valve 6, a third thermometer 22 which is disposed at the inlet side of the J-T valve 5, and a pressure gage 23 which is provided at the inlet side of the recovery valve 19.

In FIG. 2, the apparatus additionally comprises a controller 24 which receives signals from the thermometers 20, 21 and 22 and the gage 23, and controls the opening and closing of or the degrees of openings of the valves 6, 5 and 19 as will be described later.

In order to perform various preliminary operations of the helium gas liquefying apparatus thus constructed according to the present invention as described above, the compressor 2 is first operated in advance to raise the supply pressure to approx. 15.5 kg/cm$^2$. Then, in the first operation, the J-T valve 5 and the return valve 6 are closed, and the recovery valve 19 is opened to operate the cooler 3. Thus, it is cooled until the inlet temperature of the expansion engine $\mathbf{10}_2$ of the final stage is decreased to approx. 20° K., and gas in the reservoir 4 is returned through the recovery valve 19 to the recovery line 18.

In the second operation, the return valve 6 is fully opened, the J-T valve 5 is gradually opened, the recovery valve 19 remains opened, and these valves are maintained in this state until the inlet temperature of the valve 5 is decreased to approx. 20° K. and the internal pressure of the reservoir 4 is reduced to a pressure equal to or lower than 0.4 kg/cm$^2$. In this case, since the resistances of the heat exchangers $\mathbf{9}_1$ to $\mathbf{9}_5$ are large, the helium GHe flows in the line 12 reversely to the normal direction in the sequence of the outlet 12', valve 6, reservoir 4, valve 19 and line 18, or slightly flows in the normal direction. As a result, the heat exchangers $\mathbf{9}_1$ to $\mathbf{9}_5$ are not additionally heated.

Further, in the third operation, from the state of the valves in the second operation, the J-T valve 5 is further opened, and the body temperature of the return valve 6 becomes a temperature equal to or lower than 30° K. In the fourth operation, the recovery valve 19 is stepwisely closed so as to satisfy the conditions that the internal pressure in the reservoir 4 becomes a pressure equal to or lower than 0.4 kg/cm$^2$G and the inlet temperature of the valve 5 becomes a temperature equal to or lower than 20° K. In the exemplified embodiment, the branch valves $\mathbf{19}_1$, $\mathbf{19}_2$ may be sequentially closed. It is noted that, in case of one valve provided, the degree of opening of the valve is regulated to control the flow rate of the helium.

It is noted that the recovery valve 19 is stepwisely closed as described above so as to prevent the abrupt pressure rise of the reservoir 4.

In the fifth operation, the recovery valve 19 is eventually fully closed, and the valves 5 and 6 are opened to the set positions. Thus, the apparatus is to be started in liquefaction.

In the foregoing description, the J-T valve 5, return valve 6 and recovery valve 19 are manually controlled by confirming the indication of the first, second and third thermometers 20, 21 and 23 as well as the pressure gage 23. However, the apparatus may be automatically controlled in the opening and closing and the degree of the opening of these valves in accordance with the output from the controller 24 which receives electric signals dispatched from the thermometers and the gage when they are set as predetermined. In this case, the valves may be externally operated by a step motor, and the openings of the valves may be monitored by pulse counters.

It should be understood from the foregoing description that since the embodiment of the helium gas liquefying apparatus of the present invention thus comprises a liquefied helium reservoir 4, a compressor 2 receiving a helium gas stock and connected to the reservoir, a plurality of heat exchangers $\mathbf{9}_1$ to $\mathbf{9}_5$ connected in series with each other via to the inlet 11' of a series liquefying line 11, a plurality of expansion engines $\mathbf{10}_1$, $\mathbf{10}_2$ connected in parallel with corresponding heat exchangers in a cooler 3, a Joule-Thompson's valve 5 connected from the outlet of the liquefying line 11 to the reservoir 4, a series return line 12 disposed in reverse flow of the heat exchangers $\mathbf{9}_1$ to $\mathbf{9}_5$ to the liquefying line 11 and connected to the inlet of the compressor 2, a return valve 6 connected from the reservoir 4, a recovery valve 19, a recovery line 18 provided with the valve 19 and connected from the reservoir 4 through the valve 19 to the inlet side of the expansion engine $\mathbf{10}_2$, a first thermometer 20 provided at the inlet side of the expansion engine $\mathbf{10}_2$ of the final stage, a second thermometer 21 provided at the return valve 6, a third thermometer 22 provided at the inlet side of the J-T valve 5, and a pressure gage 23 provided at the inlet side of the recovery valve 19, the various preliminary operations can be completed while the delivery tubes 13 and 14 remain mounted on the He reservoir 4, thereby improving the operability of the apparatus. Since the apparatus of the invention is further controlled at the valves by the indications of the first to third thermometers 20 to 22 and the pressure gage 23, the preliminary operations can be satisfactorily carried out as required, and the apparatus of the invention can be readily fully automatized.

What is claimed is:

1. A helium gas liquefying apparatus, comprising in combination:

(a) a liquefied helium reservoir (4);

(b) a compressor (2) connected to the reservoir and receiving a helium gas stock, said compressor having an inlet side;

(c) a plurality of heat exchangers ($\mathbf{9}_1$, $\mathbf{9}_5$) connected to the compressor and to each other in series by a series liquefying line;

(d) a plurality of expansion enginer ($\mathbf{10}_1$, $\mathbf{10}_2$) connected in parallel with corresponding heat exchangers, including a final stage;

(e) a Joule-Thompson valve (5) connected from the outlet of said liquefying line to said reservoir;

(f) a series return line disposed in reverse flow of said heat exchanger to said liquefying line and connected to the compressor inlet side;

(g) a return valve (6) connected to said reservoir;

(h) a recovery valve (19) and a recovery line (18), said recovery line being connected from said reservoir (4) to said compressor inlet side, said recovery valve (19) controling the flow through said recovery line;

(i) a first thermometer (20) at the inlet side of the final stage engine;

(j) a second thermometer (21) at the return valve (6);

(k) a third thermometer (22) at said Joule-Thompson valve inlet side;

(l) a pressure gage (23) at the recovery valve inlet side;

(m) a controller (24) coupled to said first, second and third thermometers (20, 21, 22) and said pressure gage (23) receiving signals therefrom, with manual means to manually control the operation of the Joule-Thompson valve (5), the return valve (6) and the recovery valve (19); and, in operation, the compressor is first operated to raise the supply pressure to about 15.5 kg/cm$^2$, also, said manual means having, (n) means for enabling, in a first operation, the Joule-Thompson valve (5) and the return valve (6) to be closed, and the recovery valve (19) to be opened to operate the cooling of the heat exchangers, until the inlet temperature of the expansion engine final stage is decreased to approximately 20° K. and gas in the reservoir (4) is returned through the recovery valve (19) to the recovery line (18);

(o) means for enabling, in a second operation, the return valve (6) to be fully opened, the Joule-Thompson valve (5) being gradually opened, the recovery valve (19) remains opened, and these valves are maintained in this state manually until the inlet temperature of the Joule-Thompson valve (5) is depressed to approximately 20° K. and the internal pressure of the reservoir (4) is reduced to about 0.4 kg/cm$^2$ so that gas phase helium flows in the series return line to the outlet of return valve (6), the reservoir (4), the recovery valve (19) and recovery line (18) so that the heat exchangers are not additionally heated;

(p) means for enabling, in a third operation, the Joule-Thompson valve (5) to be further opened and the temperature of the return valve (6) becomes equal to or lower than 30° K.;

(q) means for enabling, in a fourth operation, the recovery valve (19) to be stepwisely closed so that the internal pressure of the reservoir (4) equals to or is lower than 0.4 kg/cm$^2$ and the inlet temperature of the Joule-Thompson valve (5) becomes equal to or lower than 20° K., and the recovery valve (19) is closed stepwisely to prevent an abrupt pressure rise of the reservoir (4); and, (r) means for enabling, in a fifth operation, the recovery valve (19) to be eventually fully closed and the Joule-Thompson and return valves are opened to the set position to start the apparatus.

* * * * *